United States Patent [19]

Clark, Jr.

[11] 4,278,069

[45] Jul. 14, 1981

[54] WATER HEATER

[75] Inventor: John A. Clark, Jr., East Stroudsburg, Pa.

[73] Assignee: Harsco Corporation, Harrisburg, Pa.

[21] Appl. No.: 117,071

[22] Filed: Jan. 31, 1980

[51] Int. Cl.[3] ..... F24H 1/36; F22G 5/00

[52] U.S. Cl. ..... 126/366; 126/360 R; 122/479 R; 122/32; 165/39; 165/108; 236/18

[58] Field of Search ..... 126/366, 360 R; 122/32, 122/479 R; 165/39, 108; 237/80, 58, 62; 236/18; 219/316

[56] References Cited

U.S. PATENT DOCUMENTS

| | | | |
|---|---|---|---|
| 1,490,860 | 4/1924 | Smith et al. | 126/366 |
| 2,296,325 | 9/1942 | Bak | 236/18 |
| 2,879,749 | 3/1959 | Lewy | 122/32 |
| 3,133,590 | 5/1964 | Lowe | 165/39 |
| 3,315,735 | 4/1967 | Stranko | 126/366 X |
| 3,351,130 | 11/1967 | Lowe | 165/39 |
| 3,364,986 | 1/1968 | Morgan et al. | 165/39 |
| 3,383,040 | 5/1968 | Darm | 236/18 |
| 3,446,939 | 5/1969 | Morgan et al. | 165/108 X |
| 3,597,588 | 8/1971 | Kirschner et al. | 122/32 X |
| 3,666,003 | 6/1972 | Clark, Jr. et al. | 165/39 |
| 3,672,444 | 6/1972 | Lowe | 165/39 |
| 3,688,839 | 9/1972 | Kirschner | 165/108 |
| 3,730,261 | 5/1973 | Clark, Jr. | 165/108 X |
| 4,046,189 | 9/1977 | Clark, Jr. | 126/360 R X |

*Primary Examiner*—Samuel Scott
*Assistant Examiner*—Randall L. Green
*Attorney, Agent, or Firm*—Kerkam, Stowell, Kondracki & Clarke

[57] ABSTRACT

A water heater comprises an elongated vessel having a heat exchanger that occupies a substantial portion at one end and leaves a minimum volume storage and blending zone at the other end of the vessel. Water is recirculated through the heat exchanger, preferably continuously, through a recirculation conduit that takes water through its inlet essentially solely from the outlet end of the heat exchange zone and returns it to the inlet end, the intake of the recirculation conduit being located at the lower end of the volume storage and immediately above an apertured partition extending across the interior of the vessel immediately above the heat exchanger. The temperature sensor of the control thermostat is received within a tunnel secured to the partition. The tunnel has two side outlet openings away from the aperture so that the thermostat is always subject to the hottest water just above the heat exchanger for fast and accurate control of the heating fluid on failure of the circulating pump.

8 Claims, 2 Drawing Figures

WATER HEATER

REFERENCE TO RELATED PATENT

The present invention is an improvement of my invention as described in U.S. Pat. No. 4,046,189 issued on Sept. 6, 1977.

BACKGROUND OF THE INVENTION

Water heaters designed for commercial, industrial and institutional applications are generally classified in one of three categories, instantaneous, semi-instantaneous and storage. A water heater falling in the instantaneous category is characterized by the absence of any significant storage capacity and by the fact that the heat exchanger occupies substantially all of the vessel or jacket. Instantaneous water heaters present difficult temperature control problems, inasmuch as cold water is delivered to the water heater and flows essentially straight through and out with no opportunity for blending and thus no opportunity for smoothing temperature variants that result from variations in demand, and the heat is supplied at a high rate, relative to the rate of water flow, thus emphasizing the lags between changes in draw and changes in heat input.

The semi-instantaneous category of water heaters is generally characterized by a relatively small tank which serves primarily as a mixing and blending zone in which water delivered from the heat exchanger is blended with water in the vessel. It is possible to obtain very close temperature control in semi-instantaneous water heaters, inasmuch as the blending principle tends to smooth out temperature gradients of water coming from the heat exchanger and thus makes the temperature of the delivered hot water less subject to variations in demand. The semi-instantaneous types often use heat anticipators or forward feed devices for further enhancement of temperature uniformity.

The storage-type water heaters are characterized by large tanks and relatively small heat exchangers and rely upon slow rates of heating of large volumes of water in the tank to maintain the water at a desired temperature. Of the three types, the storage types have the slowest recovery, and present problems of temperature control that often cannot readily be solved particularly in applications involving frequent large draws of hot water.

Each of the three types has various advantages and disadvantages, and the type selected is, of course, dependent upon the requirements of the particular installation. The present invention provides a solution to the problem, on the one hand, of the relatively high cost of presently known semi-instantaneous type water heaters, as compared to the instantaneous type, which results primarily from the large vessel required for presently known semi-instantaneous water heaters, and overcomes the disadvantage of relatively poor temperature control characteristic of instantaneous type water heaters. Accordingly, a water heater embodying the invention offers the size advantage of an instantaneous water heater and the temperature control advantage of a semi-instantaneous water heater.

Further, the present invention improves upon the operation of the hot water heater described in my patent referred to above by locating the control thermostat immediately above an apertured partition immediately above the heat exchanger in a tunnel having two side outlets with the circulating inlet opening into the tunnel for accurate and prompt control of the heating fluid on failure of the circulating pump to prevent overheating water from leaving the heater. The apertured partition or plate and the tunnel with two side outlets acts to stratify the heated water in the storage volume and blend it preventing excessively hot water from appearing at the top of the storage volume.

SUMMARY OF THE INVENTION

More particularly, there is provided, in accordance with the present invention, a water heater having a relatively small vessel, as much as 80% smaller than the tanks of presently known semi-instantaneous type water heaters, but capable of providing uniform temperature water over a wide range of demand rates with rapid response to changes in draw. A substantial portion of the vessel, generally somewhat more than half, is a heat exchange zone and contains a heat exchanger, such as a tubing bundle through which a hot fluid, generally steam or high temperature boiler water or other heating fluid, is conducted. The remainder of the vessel constitutes a minimum volume storage and blending zone. Hot water is drawn from the storage and blending zone, preferably from the end of the vessel remote from the heat exchanger. Make-up water, generally cold water from a water supply, is supplied at the inlet end of the heat exchange zone, and water is recirculated, preferably continuously, by pumping it through a recirculation conduit, the intake of which is located very close to the outlet end of the heat exchanger so that it receives essentially solely water from the heat exchange zone, and the outlet of which leads into the inlet end of the heat exchanger. An important aspect of the invention involves locating the temperature sensor of the temperature control thermostat adjacent the recirculation conduit, perferably near the intake and in a tunnel, on an apertured partition immediately above the heat exchanger, so that it is responsive to a flow of water from the heat exchange zone upon failure of the circulating pump.

Inasmuch as water coming from the heat exchange zone is a mixture of recirculated hot water and cold water that has been heated in the heat exchange zone, its temperature is indicative of the demand on the water heaters for hot water in that the amount of cold water entering the vessel is equal to the draw at any point in time. Thus, as hot water is withdrawn from the water heater, cold water enters at a rate equal to the draw, and the rate of temperature drop in leaving the heat exchange zone is indicative of the draw rate. The high velocity flow of such water over the temperature sensor will promptly detect the drop in temperature and will cause the temperature control to respond by increasing the heat input to the heat exchanger. In the meantime, the quantity of water leaving the heat exchange zone that is not recirculated is blended with water in the vessel in the storage and blending zone adjacent the hot water outlet, and therefore, a change in the temperature of the water coming from the heat exchanger tends to be smoothed out in a manner similar to known semi-instantaneous type water heaters.

Upon failure of the circulating pump enough flow of heated water from the heat exchanger will pass through the aperture of the plate or partition and will flow over the temperature sensor to adjust the flow of the heating fluid and prevent the occurrence of excessively hot water at the discharge from the storage volume.

The invention offers the advantages of having a small-sized vessel, a characteristic of an instantaneous type water heater, in combination with significantly improved temperature control, as compared to an instantaneous, a characteristic of semi-instantaneous type water heaters. It is efficient to operate, and the small size of the vessel reduces the cost of building, shipping and installing the water heater. The reduction in size of the vessel means, of course, that it occupies much less space, an important advantage to the building occupant. The water heater is not dependent upon thermal convection of the water for temperature control or other reasons and, therefore, can be mounted upright or horizontally, another contribution to flexibility of use and saving of space in many cases.

BRIEF DESCRIPTION OF THE DRAWINGS

For a better understanding and a further description of the invention, reference may be made to the following description of a preferred embodiment, taken in conjunction with the accompanying drawing in which.

DESCRIPTION OF THE PREFERRED EMBODIMENT

Figure 1:
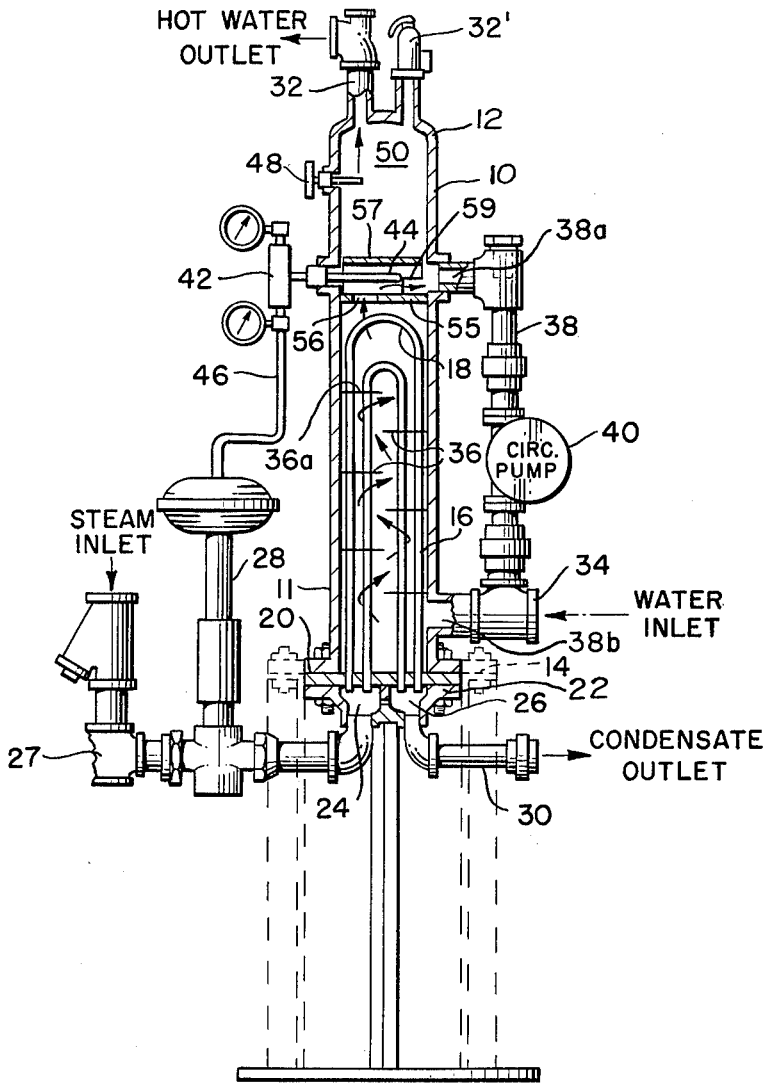
FIG. 1 is a side cross-sectional view of the embodiment in somewhat schematic form showing the location of the apertured plate or partition and tunnel with the temperature sensor therein and adjacent the recirculation inlet.
Figure 2:
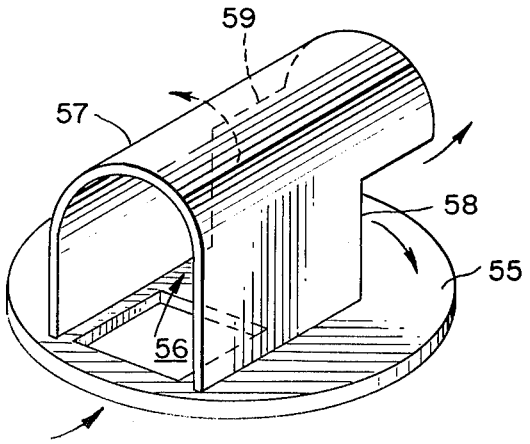
FIG. 2 is an enlarged detail of the plate and tunnel showing the location of the aperture with respect to the side openings of the tunnel and the relative areas thereof.

Reference numeral 10 designates generally an elongated vessel, the length of which is substantially greater than the dimensions of the transverse cross sections. The vessel is preferably a circular cylinder constructed of copper-silicon or some other durable, corrosion resistant material and is open at its lower end 11 and closed by an integral dome 12 at its upper end and has a circular, outwardly extending flange 14 at its lower end. A heat exchanger 16 occupies a substantial portion, generally somewhat more than one-half of the bottom of the vessel, and is constituted by a bundle of generally U-shaped tubes 18 mounted in a tube plate 20. The heat exchanger is mounted in the vessel by bolting the plate 20 between the flange 14 of the vessel and a fitting 22 that is formed to provide an inlet 24 and an outlet 26 for a hot fluid, usually either steam or hot boiler water, circulated through the tubes 18 between the inlet 24 and outlet 26. The water heater shown in FIG. 2 is set up for steam as a heat source, the steam being conducted to the inlet 24 through a pipe system 27 having a temperature control valve 28 interposed therein. Condensate is removed through a condensate outlet 30.

Hot water is drawn from the vessel 10 through a hot water outlet 32 extending from the top 12 of the vessel and a pressure relief valve is provided at 32'. Make-up cold water is conducted into the vessel through a water inlet 34 at the lower, i.e., inlet, end of the heat exchanger 16. Baffles 36 extend in from opposite sides of the vessel part way across the heat exchange zone in spaced-apart, staggered relation, thereby promoting good heat transfer conditions by increasing the velocity of the water and causing it to flow along a tortuous path represented by the arrowed lines in the drawing. The uppermost baffle **36*a* is positioned to direct the flow of water from the heat exchange zone toward the aperture 56 in plate 55** which is described immediately below.

Hot water is recirculated, preferably continuously, back through the heat exchanger by a recirculation system composed of a recirculation conduit 38 and a pump 40. An inlet portion **38*b* of the recirculation conduit opens horizontally into the vessel, the intake 38*a* thereof being positioned very close to the heat exchanger above a partition to be described hereinafter. Accordingly, the water drawn into the recirculation conduit is essentially exclusively water that comes from the outlet end of the heat exchanger through an aperture in the partition. The outlet 38*b* from the recirculation conduit 38 leads into the inlet end of the heat exchange zone at the bottom of the vessel; preferably, but not necessarily, the cold water inlet 34 and the recirculation outlet 38*b*** are coincident.

The temperature of the hot water produced in the water heater is controlled by a temperature control thermostat 42 which includes a temperature sensing probe 44 located adjacent the recirculating inlet **38*a*. In the embodiment shown in the drawing, the temperature sensing probe 44 is located spaced from and above partition or plate 55 having an aperture 56 both immediately above the heat exchanger 18 and in tunnel 57 having side outlet openings 58 and 59 adjacent recirculating inlet 38*a*, partition or plate It will be seen that aperture 56 is adjacent one end of a diameter of plate 55 while openings 58 and 59** are adjacent the other end of the diameter.

It has been determined that the area of orifice 56 should be approximately 10% of the total area of the plate 50. The cross sectional area of tunnel 57 should be approximately between 15 and 20% of the total area of plate 55. The combined area of the two side outlet openings 58 and 59 in tunnel 57 should be approximately 10% of the total area of plate 55.

For example, for a 6" nominal diameter heater 10, the inside diameter thereof is approximately 6⅛". The plate 55 is then 6" diameter, the rectangular orifice 54 in plate 55 is 2" long by 1½" wide. The height of tunnel 57 is 2" and the width is 2". The two side outlets 58 and 59 in the tunnel each measure 1" in height by 1½" long.

The 6" diameter unit is the smallest size tested and tests on 8", 10" and 12" nominal diameter heaters have been conducted. It has been found that the orifice and tunnel dimensions should be increased proportionately to maintain the same percentage ratios as indicated above for the larger sizes, 8" through 12". Larger than 12" diameter units would require the same proportions. This is logical since the heating capacity of the units increases almost in direct ratio to the cross-sectional area of the heater shell, which in turn, determines the diameter of the orifice plate.

The disposition and areas of openings 56, 58 and 59 cause circulation of the heated water from the heat exchanger 38 to circulate in the direction of the arrows in FIG. 2, the heated water leaving openings 58 and 59 moves in flat spirals into the volume 50 for stratification and blending thereof with the stored heated water for a more uniform gradient of temperature to outlet 32 preventing any sudden delivery of overheated water. The thermostat is responsive to temperature changes of the recirculated hot water with a minimum of delay particularly upon failure of the circulating pump 40. The temperature control thermostat and the sensor may be of any suitable type, many of which are well known to those skilled in the art, the one illustrated being of a pneumatic type. The temperature control thermostat 42 is connected by a line 46 to the temperature control valve 28 and controls the valve 28 to supply steam from the inlet of the heat exchanger at a rate such that the temperature of the water leaving the heat exchange zone is maintained substantially constant. The water heater also includes a thermometer 48 adjacent the hot water outlet, the thermometer merely permitting the temperature of the hot water to be determined but playing no role in the control of the water heater.

The rate of supply of steam to the heat exchanger varies according to the draw of hot water from the outlet 32 which, of course, directly affects the rate of intake of make-up cold water and, thus, the requirement for heat input to the heat exchanger. The ability of the water heater to produce hot water of substantially constant temperature at the hot water outlet, despite the absence of the large storage and blending zone characteristic of both storage and semi-instantaneous type water heaters, results from the construction of the water heater in a way that minimizes the time of response between a change in the temperature of water leaving the heat exchange zone and adjustment of the supply of steam to the heat exchanger and from the provision for recirculation of a substantial part of the hot water coming from the heat exchanger at all times.

The response time of the thermostat is reduced by reason of the location of the temperature sensing probe above partition or plate 55 where there is a velocity flow of water over the probe even on failure of the circulating pump 40, thus maintaining the rate of heat transfer from the water to the probe, as compared to the rate of heat transfer that would be obtained if the probe were located elsewhere in the water heater vessel. In addition, the temperature sensing probe senses the temperature of water that comes substantially exclusively from the outlet end of the heat exchanger, which is necessarily water that will tend to vary in temperature relatively widely in response to changes in hot water draw from the water heater, and that indeed has the greatest variation in temperature of any water in the vessel.

The recirculation of hot water through the heat exchanger by way of the recirculation conduit 38 provides a result very similar to that provided by a relatively high volume blending and storage zone in that a substantial part of the water coming from the heat exchanger is kept in closed circuit in the recirculation system, thus reducing the amount of water coming from the heat exchanger that goes to the hot water outlet. In general, it is desirable for good temperature control to recirculate hot water at a rate of about 20% or more of the normal draw for which the water heater is designed.

At times when the water heater is operating at a relatively high demand or draw rate, the rate of steam supply to the heat exchanger will be relatively high, inasmuch as a substantial part of the water coming through the inlet **38*b* will be cold, make-up water. Assuming a steady-state operation at a high draw, the temperature control valve will be set in response to the temperature control thermostat to provide delivery of water from the heat exchanger at a temperature close to the temperature of the water discharged from the outlet. Although a substantial part, perhaps 20% or more, of the water coming from the outlet of the heat exchanger is continuously recirculated through the conduit 38, a substantial part, say the other 80%, is drawn off relatively quickly through the hot water outlet. Upon a drop in demand, which will often be a relatively large fraction of the then existing high total demand, the temperature of water coming from the heat exchanger will increase due to a decrease in the amount of cold water coming in the inlet 34. The temperature probe is, as described above, highly sensitive to temperature changes of the water coming from the heat exchanger by reason of its location above the apertured partition or plate 55 and within the tunnel 57 and will produce a relatively rapid response of the thermostat and the control valve to reduce the supply of steam to the heat exchanger particularly upon failure of pump 40. Inasmuch as it is probable that at periods of high demand, percentage changes in draw can be relatively high, the water heater can readily maintain close tolerance to a desired temperature in the hot water delivered inasmuch as a percentage of the higher temperature water leaving the heat exchanger is recirculated and the remaining part is blended with water already in the blending zone 50**, and the temperature of water leaving the heat exchanger is not greatly increased.

In periods of low demand, the percentage change in draw is likely to be somewhat greater, and the recirculation system plays a more important role in temperature control in that most of the water coming from the heat exchanger circulates in closed circuit back through the heat exchanger, with only a relatively small fraction being discharged to the storage and blending area 50. Thus, even though there may be a relatively large percentage change in demand during periods of low overall demand, which will, in turn, produce a relatively large and rapid change in the temperature of the water discharged from the heat exchanger, only a small fraction of the water coming from the heat exchanger goes to the storage and blending area 50 where it is blended with water of the desired temperature. Accordingly, the relatively high percentage change in demand at low overall demand rates produces little change in the temperature of the water delivered at the hot water outlet. Moreover, the storage and blending zone 50 becomes more significant in low draw situations, in that it provides a reservoir for water of the desired temperature from which demand may be satisfied during the short times when transient conditions prevail in the heat exchange zone.

Under all conditions, the high rate of recirculation smoothes out the temperature variations that would exist in water leaving the heat exchanger if only cold water were being heated.

I claim:

1. A water heater having an elongated vessel having an open end and a closed end;

heat exchange means received within said open end and defining within the vessel a heat exchange zone occupying a major portion of the volume of the vessel and leaving a minor portion of the volume of the vessel for a storage and blending zone adjacent the closed end of the vessel, the heat exchange means including a bundle of elongated heat exchange elements spaced over substantially the full cross-sectional extent of the vessel, said cross section being perpendicular to the direction of elongation of the vessel, and extending from said open end towards said closed end over the major portion of the length of the vessel;

a cold water inlet located adjacent said open end of the vessel;

a hot water outlet located adjacent said closed end of the vessel in the storage and blending zone and remote from the heat exchange zone; and means for recirculating water through the heat exchange zone of the vessel including a recirculation conduit, the improvement comprising the conduit having an inlet opening horizontally within the vessel closely adjacent an inner end of the bundle of heat exchange elements for drawing water essentially solely from the heat exchange zone of the vessel and an outlet communicating with the vessel and said cold water inlet adjacent said open end thereof for conduction of water into and through the heat exchange zone; and control means for controlling the input of heat to the heat exchange means in response to temperature changes in the water coming from the heat exchange zone of the vessel and for stratifying and blending the heated water in the storage and blending zone, the control means including an apertured plate above the heat exchange zone dividing the interior of the vessel, a temperature sensor immediately above said plate, a tunnel mounted on said plate over said sensor and extending across the interior of the vessel, and opening into the recirculation conduit, and side outlet openings in the tunnel adjacent the inlet of the recirculating conduit for flow of heated water to the storage zone, such that the sensor is responsive to a flow of water essentially solely from the heat exchange zone of the vessel.

2. A water heater according to claim 1 wherein the temperature sensor is spaced from the plate and above the aperture therein.

3. A water heater according to claim 1 and further comprising a multiplicity of baffles in the heat exchange zone extending part way across the vessel in the direction of said cross section from opposite walls thereof and in staggered, longitudinally-spaced relation to each other to promote mixing of water in the heat exchange zone and increase the length of the effective flow path of water therethrough, the baffle closest to the inlet to the recirculation conduit being located to direct the flow of water from the heat exchange zone toward the aperture in the plate.

4. A hot water heater according to claim 1 wherein said recirculating means includes means for drawing said water at a substantial rate determined so as to have the effect of keeping a large part of the water coming from the heat exchange means in closed circuit in the vessel, said effect in the water heating system thereby permitting close temperature regulation of hot water drawn from the system.

5. The water heater described in claim 1, wherein the rate of draw off of water by the recirculating means is approximately 20% of the water coming from the heat exchange means.

6. The water heater described in claim 5, wherein the rate of draw off of water by the recirculating means is at least 20% of a normal draw for which the water heater is designed.

7. A hot water heater according to claim 1 wherein the area of the aperture in the plate is approximately 10% of the area of the plate, the cross-sectional area of the tunnel is between about 15% and 20% of the area of the plate and the sum of the areas of the side outlet openings in the tunnel is approximately 10% of the area of the plate.

8. A hot water heater according to claim 1 wherein the aperture in the plate is adjacent one end of a diameter of the plate and the side outlet openings in the tunnel are adjacent the other end of the same diameter of the plate.

* * * * *